US009251943B2

(12) United States Patent
Jeong et al.

(10) Patent No.: US 9,251,943 B2
(45) Date of Patent: Feb. 2, 2016

(54) MULTILAYER TYPE INDUCTOR AND METHOD OF MANUFACTURING THE SAME

(75) Inventors: Dong Jin Jeong, Busan (KR); Hyeog Soo Shin, Busan (KR); Jae Wook Lee, Gyeongsangnam-do (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/620,676

(22) Filed: Sep. 14, 2012

(65) Prior Publication Data

US 2013/0113593 A1 May 9, 2013

(30) Foreign Application Priority Data

Nov. 7, 2011 (KR) ..... 10-2011-0114898

(51) Int. Cl.

| | |
|---|---|
| ***H01F 5/00*** | (2006.01) |
| ***H01F 27/24*** | (2006.01) |
| ***H01F 17/00*** | (2006.01) |
| ***H01F 27/29*** | (2006.01) |
| ***H01F 41/04*** | (2006.01) |

(52) U.S. Cl.

CPC ..... *H01F 17/0013* (2013.01); *H01F 17/0033* (2013.01); *H01F 27/292* (2013.01); *H01F 41/046* (2013.01); *Y10T 29/4902* (2015.01)

(58) Field of Classification Search

CPC ..... H01F 17/0013; H01F 17/0033; H01F 41/046; H01F 27/292; Y10T 29/4902

USPC ..... 336/200, 83, 223, 232, 233

See application file for complete search history.

(56) References Cited

U.S. PATENT DOCUMENTS

| | | | | |
|---|---|---|---|---|
| 6,373,368 | B1 * | 4/2002 | Shikama et al. | 336/200 |
| 6,710,694 | B2 * | 3/2004 | Matsuta et al. | 336/200 |
| 2003/0102951 | A1 * | 6/2003 | Nakano et al. | 336/200 |
| 2010/0271163 | A1 * | 10/2010 | Nakamura et al. | 336/200 |
| 2010/0308949 | A1 * | 12/2010 | Lim et al. | 336/218 |
| 2011/0181384 | A1 * | 7/2011 | Inuduka et al. | 336/234 |
| 2011/0309904 | A1 * | 12/2011 | Aoki et al. | 336/105 |
| 2012/0019343 | A1 * | 1/2012 | Hsieh et al. | 336/192 |
| 2012/0105188 | A1 | 5/2012 | Lim et al. | |

FOREIGN PATENT DOCUMENTS

| | | | |
|---|---|---|---|
| KR | 2009-0097303 | A | 9/2009 |
| KR | 2010-0119641 | A | 11/2010 |

* cited by examiner

*Primary Examiner* — Mangtin Lian

(74) *Attorney, Agent, or Firm* — McDermott Will & Emery LLP

(57) ABSTRACT

There is provided a multilayer type inductor, including: an inductor main body; a coil part having conductive circuits and conductive vias formed in the inductor main body; and external electrodes formed on both ends of the inductor main body, wherein in the inductor main body, at least parts around the conductive circuits and the conductive vias are formed of a ferrite material or a non-magnetic material.

20 Claims, 2 Drawing Sheets

MULTILAYER TYPE INDUCTOR AND METHOD OF MANUFACTURING THE SAME

CROSS-REFERENCE TO RELATED APPLICATIONS

This application claims the priority of Korean Patent Application No. 10-2011-0114898 filed on Nov. 7, 2011, in the Korean Intellectual Property Office, the disclosure of which is incorporated herein by reference.

BACKGROUND OF THE INVENTION

1. Field of the Invention

The present invention relates to a multilayer type inductor and a method of manufacturing the same.

2. Description of the Related Art

In terms of electronic parts using a ceramic material, there may be provided a capacitor, an inductor, a piezoelectric element, a varistor, a thermistor, or the like.

Among these ceramic electronic parts, the inductor is one of the main passive elements constituting an electronic circuit, and serves to remove noise or constitute an LC resonance circuit.

This inductor may be manufactured by winding a coil around a ferrite core or printing a coil, and then forming electrodes at both ends thereof, or by printing internal electrodes on a magnetic material or a dielectric material and laminating them.

Inductors may be classified into several types, such as a multilayer type, a winding type, a thin film type, and the like, according to a structure thereof, the multilayer type being widely employed.

The multilayer type inductor is manufactured to have a laminate form in which a plurality of ceramic sheets, formed of ferrite or low-k dielectric, are laminated.

A coil type metal pattern is formed on each ceramic sheet. Coil type metal patterns formed on respective ceramic sheets are sequentially connected through conductive vias formed in the respective ceramic sheets, and overlap in a laminating direction, to constitute a coil having a helical structure.

Both ends of the coil are drawn out to an external surface of the laminate and connected to external terminals.

The multilayer type inductor may be manufactured as a separate component in a chip type, or may be formed together with other modules while it is embodied in a board.

Generally, the multilayer type inductor has a structure in which a plurality of magnetic layers having metal patterns thereon are laminated. The metal patterns are sequentially connected by via electrodes formed on the respective magnetic layers so that they overlap in a laminating direction, resulting in a coil having a helical structure.

Since this coil of the multilayer type inductor is surrounded by a magnetic material, the magnetic material around the coil is likely to be magnetized when a high current is applied thereto.

In addition, a part around the coil is magnetized, and thus, an inductance (L) value of the inductor is changed, thereby deteriorating capacitance characteristics of the inductor.

SUMMARY OF THE INVENTION

An aspect of the present invention provides new methods required in order to improve electric properties of a multilayer type inductor.

According to an aspect of the present invention, there is provided a multilayer type inductor, including: an inductor main body; a coil part having conductive circuits and conductive vias formed in the inductor main body; and external electrodes formed on both ends of the inductor main body, wherein in the inductor main body, at least parts around the conductive circuits and the conductive vias are formed of a ferrite material or a non-magnetic material.

The coil part may have a core formed therein.

The core may be formed of a ferrite material or a non-magnetic material.

The core may be formed of a material containing a metal powder.

The multilayer type inductor may further include: an upper cover layer formed on an upper surface of the inductor main body; and a lower cover layer formed on a lower surface of the inductor main body.

The upper cover layer and the lower cover layer may include the metal powder.

The metal powder may have a particle size distribution of 0.5 to 5 μm, may have a particle size distribution of 10 to 20 μm, or may have the particle size distribution of 0.5 to 5 μm and the particle size distribution of 10 to 20 μm in a mixture.

The inductor main body may be formed of a ferrite material or a non-magnetic material.

The inductor main body may be formed of a material containing the metal powder.

The multilayer type inductor may further include an insulating layer formed on an outer surface of the upper cover layer, the lower cover layer, and the inductor main body.

The ferrite material may have a particle size distribution of 0.5 to 20 μm.

According to another aspect of the present invention, there is provided a method of manufacturing a multilayer type inductor, including: preparing a plurality of sheets formed of a material containing a metal powder, and each having a conductive circuit and a conductive via, around which parts are formed of a ferrite material or a non-magnetic material; and forming an inductor main body by laminating the plurality of sheets so that one end of the conductive circuit formed on each of the sheets contacts the conductive via formed to pass through a neighboring sheet to form a coil part.

The method may further include forming a lower cover layer containing the metal powder on a lower surface of the inductor main body and forming an upper cover layer containing the metal powder on an upper surface of the inductor main body.

The upper and lower cover layers may each be formed by laminating a cover sheet formed of a material containing the metal powder thereon, or the upper and lower cover layers may be formed by printing a paste formed of a material containing the metal powder on upper and lower surfaces of the inductor main body, respectively.

According to another aspect of the present invention, there is provided a method of manufacturing a multilayer type inductor, including: preparing a plurality of sheets formed of a ferrite material or a non-magnetic material, and each having a conductive circuit and a conductive via, around which parts are formed of the ferrite material or the non-magnetic material; forming an inductor main body by laminating the plurality of sheets so that one end of the conductive circuit formed on each of the sheets contacts the conductive via formed to pass through a neighboring sheet to form a coil part; laminating a lower cover sheet formed of a material containing a metal powder on a lower surface of the inductor main body; and laminating an upper cover sheet formed of a material containing the metal powder on an upper surface of the inductor main body.

According to another aspect of the present invention, there is provided a method of manufacturing a multilayer type inductor, including: preparing a plurality of sheets formed of a ferrite material or a non-magnetic material, and each having a conductive circuit and a conductive via, around which parts are formed of the ferrite material or the non-magnetic material; forming an inductor main body by laminating the plurality of sheets so that one end of the conductive circuit formed on each of the sheets contacts the conductive via formed to pass through a neighboring sheet to form a coil part; forming a lower cover layer by printing a paste formed of a material containing a metal powder on a lower surface of the inductor main body; and forming an upper cover layer by printing the paste formed of the material containing the metal powder on an upper surface of the inductor main body.

According to another aspect of the present invention, there is provided a method of manufacturing a multilayer type inductor, including: preparing a plurality of sheets formed of a ferrite material or a non-magnetic material, and each having a conductive circuit and a conductive via, around which parts are formed of the ferrite material or the non-magnetic material; forming an inductor main body by laminating the plurality of sheets so that one end of the conductive circuit formed on each of the sheets contacts the conductive via formed to pass through a neighboring sheet to form a coil part; forming a through hole passing through an inner portion of the coil part; and forming a core part formed of a material containing the metal powder in the through hole.

The method may further include forming external electrodes on both ends of the inductor main body.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
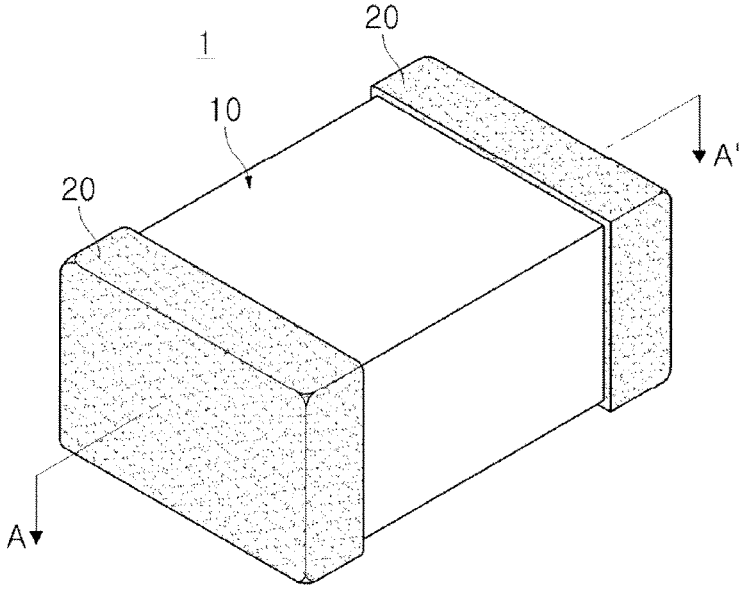
FIG. 1 is a perspective view showing a schematic structure of a multilayer type inductor according to one embodiment of the present invention.

Hereinafter, embodiments of the present invention will be described in detail with reference to the accompanying drawings so that they may be easily practiced by those skilled in the art to which the present invention pertains.

However, the invention may be embodied in many different forms and should not be construed as being limited to the embodiments set forth herein.

The embodiments of the present invention are provided so that those skilled in the art may more completely understand the present invention.

In the drawings, the shapes and dimensions may be exaggerated for clarity, and the same reference numerals will be used throughout to designate the same or like components.

In addition, like reference numerals denote parts performing similar functions and actions throughout the drawings.

In addition, unless explicitly described otherwise, "comprising" any components will be understood to imply the inclusion of other components but not the exclusion of any other components.

Figure 2:
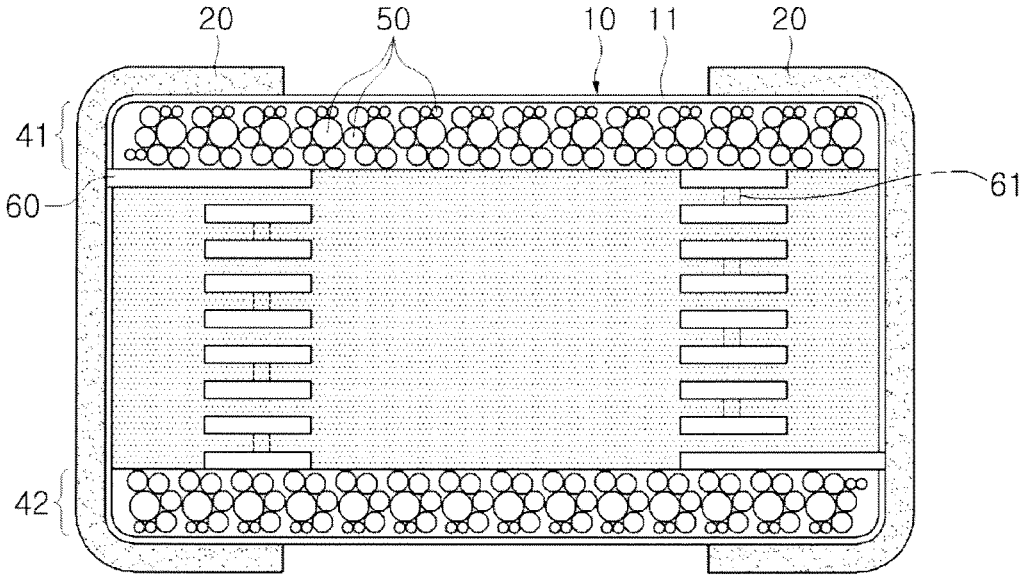
FIG. 2 is a cross-sectional view taken along line A-A' of FIG. 1.

FIG. 1 is a perspective view showing a schematic structure of a multilayer type inductor according to one embodiment of the present invention; and FIG. 2 is a cross-sectional view taken along line A-A' of FIG. 1.

Referring to FIGS. 1 and 2, a multilayer type inductor 1 according to one embodiment of the present invention may include an inductor main body 10, a coil part 60 formed in the inductor main body 10, and a pair of external electrodes formed on both ends of the inductor main body 10.

Here, at least a part around the coil part 60 is formed of a ferrite material or a non-magnetic material.

The inductor main body 10 may be formed by laminating a plurality of sheets formed of a ferrite material, laminating non-magnetic sheets formed of a non-magnetic material, or, as necessary, printing a paste formed of the same material. However, a method of forming the inductor main body of the present invention is not limited thereto.

Here, the non-magnetic sheet is not particularly limited, but the non-magnetic sheet may be prepared by pulverizing and mixing a non-magnetic powder, a binder, a plasticizer, and the like, using a ball mill to prepare a slurry, which is then molded in a sheet type.

Each conductive circuit (not shown) may be formed on one surface of each of the sheets constituting the inductor main body 10, and a conductive via 61 may be formed to pass through each of the sheets in a thickness direction thereof.

The conductive circuit is not particularly limited, but may be formed by, for example, thick film printing, coating, depositing, sputtering, or the like.

In addition, the conductive via 61 may be provided by forming a via hole in the sheets and filling the via hole with a conductive paste or the like.

Here, the conductive paste may include a metal, such as Ag, Ag—Pd, Ni, Cu, or the like.

One end of the conductive circuit formed on each sheet may be in contact with a conductive via 61 formed to pass through a neighboring sheet.

In addition, the conductive circuits formed on the respective sheets may be connected to each other by the conductive vias 61, to form a winding coil part 60.

Here, the number of sheets on which the conductive circuit is formed may be determined depending on electric properties required in the inductor 1, such as an inductance or the like.

Both ends of the coil part 60 constituted as above may be drawn to the outside of the inductor main body 10 so that they are electrically connected to first and second external electrodes 20, respectively.

Here, parts around the conductive circuits and the conductive vias 61 may contain a ferrite material or a non-magnetic material. The ferrite material may have a particle size distribution of 0.5 to 20 μm, but the present invention is not limited thereto.

Here, the multilayer type inductor 1 may further include a lower cover layer 42 formed on a lower surface of the inductor main body 10 and an upper cover layer 41 formed on an upper surface of the inductor main body 10.

In addition, an insulating layer 11 may be formed to surround an outer surface of the inductor main body 10. Here, when the upper cover layer 41 and the lower cover layer 42 are present, the insulating layer 11 may be formed to surround outer surfaces of the upper and lower cover layers 41 and 42.

The lower cover layer 42 and the upper cover layer 41 are not particularly limited, but they may be formed by pulverizing and mixing a metal powder, a binder, a plasticizer, or the like, using a ball mill, to prepare a slurry and using the slurry.

Here, a metal powder 50 contained in the lower cover layer and the upper cover layer may have various particle sizes, and for example, may have a particle size distribution of 0.5 to 5 μm or a particle size distribution of 10 to 20 μm.

However, the present invention is not limited thereto, and may be variously modified. For example, as necessary, the metal powder may be constituted by mixing the particle size distribution of 0.5 to 5 μm and the particle size distribution of 10 to 20 μm.

The pair of external electrodes 20 may be formed on the outer surface of the inductor main body 10, and may be electrically connected to both ends of the coil part 60, respectively.

These external electrodes 20 may be formed by immersing the inductor main body in the conductive paste or using printing, depositing, sputtering, or the like.

Here, the conductive paste may contain a metal, such as Ag, Ag—Pd, Ni, Cu, or the like.

In addition, a Ni plating layer and a Sn plating layer may be formed on surfaces of the external electrodes 20.

In the winding type inductor, an air gap on which the coil is wound is formed in a core having an I-letter cross-section. Therefore, the winding type inductor can have superior DC bias characteristics.

However, an inner portion of the inductor main body and an inner portion of the coil part all are generally formed of a ferrite material.

In this multilayer type inductor, an increase of current may bring about magnetic saturation, resulting in a rapid decrease in inductance (deterioration in DC bias characteristics).

The multilayer type inductor 1 according to the present embodiment has a composite structure in which parts around the conductive circuits and the conductive vias 61 of the coil part 60 may be formed of a ferrite material or a non-magnetic material, and the other part may be formed of a material containing a metal powder 50, and may have a similar type to the winding type inductor.

In addition, magnetic flux induced by the coil part 60 may be concentrated on a core part in the center, thereby preventing a part around the coil part 60 from being magnetized.

In other words, a deterioration in an L value may be prevented even at high current by utilizing strengths of a metal material, and a short circuit between electrodes may be prevented at the time of heating, by forming a ferrite material or a non-magnetic material around the conductive circuits and the conductive vias, thereby improving material loss due to high frequency.

Figure 3:
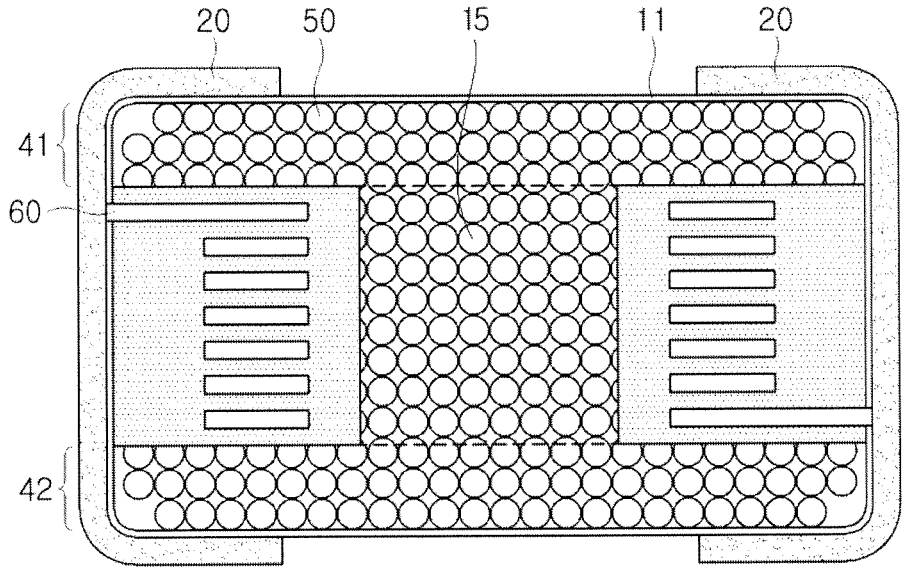
FIG. 3 is a cross-sectional view showing a schematic structure of a multilayer type inductor according to another embodiment of the present invention.

FIG. 3 is a schematic cross-sectional view showing a multilayer type inductor according to another embodiment of the present invention.

The same reference numerals as the above-described embodiment will be used to designate the same components, and the other components will be mainly described.

Referring to FIG. 3, a multilayer type inductor 1 according to the present embodiment may include an inductor main body 10, a coil part 60 formed in the inductor main body 10, and a core 15 formed within the coil part 60.

Here, a pair of external electrodes 20 may be formed on an outer surface of the inductor main body 10.

The inductor main body 10 may be formed by laminating a plurality of sheets formed of a ferrite material or a non-magnetic material or printing.

The core 15 formed within the coil part 60 may be formed of a material containing a metal powder, unlike the other part of the inductor main body 10.

The multilayer type inductor 1 according to the present embodiment may prevent an L value from being decreased even at relatively high current since the inductor has a composite structure and an inner portion of the coil part has the characteristics of a metal material, and may prevent a short circuit between electrodes at the time of heating since an outer portion of the coil part 60 has the characteristics of a ferrite material, thereby improving material loss due to the application of a high frequency current.

Here, the multilayer type inductor 1 may further include a lower cover layer 42 formed on a lower surface of the inductor main body 10 and an upper cover layer 41 formed on an upper surface of the inductor main body 10.

The lower cover layer 42 and the upper cover layer 41 are not particularly limited, but they may be formed by mixing a metal powder, a binder, a plasticizer, or the like, using a ball mill or a roll, to prepare a slurry or a paste, and then by using the slurry or paste.

Here, the metal powder contained in the lower cover layer 42 and the upper cover layer 41 may have a particle size distribution of 0.5 to 5 μm or a particle size distribution of 10 to 20 μm.

However, the present invention is not limited thereto, and may be variously modified. For example, as necessary, the metal powder may be constituted by mixing the particle size distribution of 0.5 to 5 μm and the particle size distribution of 10 to 20 μm.

Figure 4:
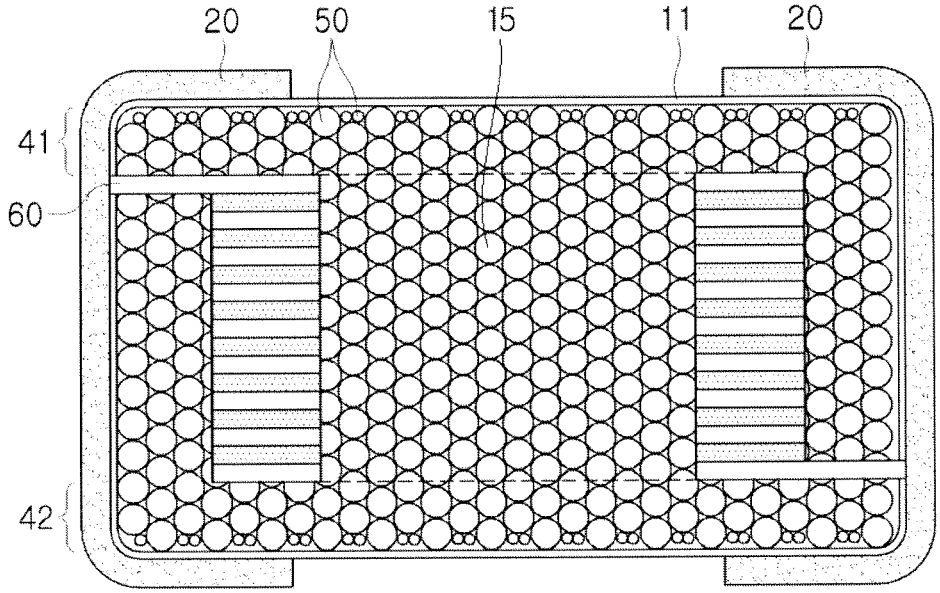
FIG. 4 is a cross-sectional view showing a schematic structure of a multilayer type inductor according to another embodiment of the present invention.

FIG. 4 is a schematic cross-sectional view showing a multilayer type inductor according to another embodiment of the present invention.

The same reference numerals as the above-described embodiment will be used to designate the same components, and the other components will be mainly described.

Referring to FIG. 4, a multilayer type inductor 1 according to the present embodiment may include an inductor main body 10, a coil part 60 formed in the inductor main body 10, and a core 15 formed within the coil part 60.

Here, a pair of external electrodes 20 may be formed on an outer surface of the inductor main body 10.

The inductor main body 10 may be formed by laminating a plurality of sheets formed of a material containing the metal powder 50 or printing, and the core 15 formed within the coil part 60 may be also formed of a material containing the metal powder 50, the same material as that of the inductor main body.

The multilayer type inductor 1 according to the present embodiment may prevent an L value from being decreased even at high current since the inductor has a composite structure and an inner portion of the coil part has the characteristics of a metal material, and may prevent a short circuit between electrodes at the time of heating since an outer portion of the coil part 60 has the characteristics of a ferrite material, thereby improving material loss due to high frequency.

Here, the multilayer type inductor 1 may further include a lower cover layer 42 formed on a lower surface of the inductor main body 10 and an upper cover layer 41 formed on an upper surface of the inductor main body 10.

The lower cover layer 42 and the upper cover layer 41 are not particularly limited, but they may be formed by mixing a metal powder, a binder, a plasticizer, or the like, using a ball mill or a roll, to prepare a slurry or a paste, and then by using the slurry or paste.

Here, the metal powder contained in the lower cover layer 42 and the upper cover layer 41 may have a particle size distribution of 0.5 to 5 μm or a particle size distribution of 10 to 20 μm.

However, the present invention is not limited thereto, and may be variously modified. For example, the metal powder may be constituted by mixing the particle size distribution of 0.5 to 5 μm and the particle size distribution of 10 to 20 μm.

Hereinafter, a method of manufacturing the multilayer type inductor according to the embodiment of the present invention will be described.

First, a conductive circuit and a conductive via 61 formed of a material containing a metal powder 50 may be formed.

The conductive circuit is not particularly limited, but may be formed by, for example, thick film printing, coating, depositing, sputtering, or the like.

In addition, the conductive via (not shown) may be provided by forming a via hole and filling the via hole with a conductive paste or the like.

The conductive paste may contain a metal, such as Ag, Ag—Pd, Ni, Cu, or the like.

Next, a plurality of sheets may be laminated, to form an inductor main body 10.

Here, the plurality of sheets may be laminated such that one end of the conductive circuit formed on each of the sheets contacts the conductive via 61 formed to pass through a neighboring sheet, thereby forming a winding coil part 60.

Next, a through hole may be formed within the coil part 60.

The through hole is not particularly limited, but may be formed by using, for example, a laser or a punching machine.

Also, the inductor main body 10 having the through hole formed therein may be laminated or printed on the lower cover sheet. However, a method of forming the inductor main body of the present invention is not limited thereto.

Then, a core 15 may be formed by filling the through hole formed within the coil part 60 with a material containing the metal powder 50.

Then, an upper cover layer 41 may be formed by laminating an upper cover sheet on the inductor main body 10 or printing a paste formed of the same material on the inductor main body 10.

The lower cover sheet, the core, and the upper cover sheet may constitute so-called the core part. Here, the forming order of the lower cover sheet, the core, and the upper cover sheet is not particularly limited.

Also, without being limited to, the core may be formed by pulverizing and mixing a magnetic powder, a binder, a plasticizer, and the like, using a ball mill to prepare a slurry, or by filling an inner portion of the core part with the slurry or paste.

Then, the inductor main body 10 having the core formed therein may be fired, and a pair of external electrodes 20 may be formed on an outer surface of the inductor main body 10.

The external electrodes 20 may be electrically connected to both ends of the coil part 60, respectively.

Also, these external electrodes 20 may be formed by immersing the inductor main body in the conductive paste or using printing, depositing, sputtering, or the like.

Here, the conductive paste may contain a metal, such as Ag, Ag—Pd, Ni, Cu, or the like.

Also, a Ni plating layer and a Sn plating layer may be formed on surfaces of the external electrodes 20

Hereinafter, the method of manufacturing a multilayer type inductor according to another embodiment of the present invention will be described.

First, a sheet or a paste having any one of non-magnetic property and magnetic property may be prepared, and a conductive pattern and a conductive via 61 may be formed in the sheet. Here, a via hole may be formed inside the conductive pattern.

Thereafter, a plurality of sheets may be laminated such that one end of the conductive pattern formed on each sheet contacts the conductive via 61 formed to pass through a neighboring sheet, to form a coil part 60. Therefore, an inductor main body 10 having magnetic or non-magnetic property may be formed.

As set forth above, according to one embodiment of the present invention, a short circuit between electrodes and material loss due to high frequency may be prevented at the time of heating by using a ferrite material, and a deterioration in an L value at high current may be prevented by using a metal powder material.

While the present invention has been shown and described in connection with the embodiments, it will be apparent to those skilled in the art that modifications and variations may be made without departing from the spirit and scope of the invention as defined by the appended claims.

What is claimed is:

1. A multilayer type inductor, comprising:

an inductor main body;

a coil part having conductive circuits and conductive vias formed in the inductor main body;

external electrodes formed on both ends of the inductor main body; and an insulating layer disposed to cover an outer surface of the inductor main body except for exposed portions of the coil part, wherein the inductor main body has a core formed inside of the coil part, and at least a part of the core is formed of a metal powder and other parts of the core are formed of a ferrite material or a non-magnetic material, and wherein parts around the conductive circuits and the conductive vias in the inductor main body are formed of the ferrite material or the non-magnetic material.

2. The multilayer type inductor of claim 1, further comprising:

an upper cover layer formed on an upper surface of the inductor main body; and a lower cover layer formed on a lower surface of the inductor main body.

3. The multilayer type inductor of claim 2, wherein the upper cover layer and the lower cover layer include the metal powder.

4. The multilayer type inductor of claim 3, wherein the metal powder has a particle size distribution of 0.5 to 5 μm.

5. The multilayer type inductor of claim 3, wherein the metal powder has a particle size distribution of 10 to 20 μm.

6. The multilayer type inductor of claim 3, wherein the metal powder has the particle size distribution of 0.5 to 5 μm and the particle size distribution of 10 to 20 μm in a mixture.

7. The multilayer type inductor of claim 2, wherein the insulating layer is disposed on an outer surface of the upper cover layer, the lower cover layer, and the inductor main body.

8. The multilayer type inductor of claim 1, wherein the ferrite material has a particle size distribution of 0.5 to 20 μm.

9. The multilayer type inductor of claim 7, wherein the insulating layer formed on the outer surface of the upper cover layer, the lower cover layer, and the inductor main body has a substantially rectangular cross section, and each external electrode is disposed on at least three sides of the substantially rectangular cross section of the insulating layer.

10. The multilayer type inductor of claim 9, wherein each external electrode is electrically coupled to a respective end of the coil part.

11. The multilayer type inductor of claim 7, wherein the insulating layer formed on the outer surface of the upper cover layer, the lower cover layer, and the inductor main body has a substantially parallelepiped shape, and each external electrode is disposed on at least five sides of the substantially parallelepiped shaped insulating layer.

12. The multilayer type inductor of claim 11, wherein each external electrode is electrically coupled to a respective end of the coil part.

13. The multilayer type inductor of claim 1, wherein the core has a through hole therein, and the through hole is filled with the metal powder.

14. The multilayer type inductor of claim 1, wherein the insulating layer is disposed between the inductor main body and the external electrodes.

15. A multilayer type inductor, comprising:

an inductor main body;

a coil part having conductive circuits and conductive vias formed in the inductor main body;

external electrodes formed on both ends of the inductor main body; and an insulating layer disposed to cover an outer surface of the inductor main body except for exposed portions of the coil part, wherein the inductor main body has a core formed inside of the coil part, and the core includes a metal powder, wherein the multilayer type inductor has a composite structure in which parts around the conductive circuits and the conductive vias of the coil part are formed of a different material than the core.

16. The multilayer type inductor of claim 15, wherein the multilayer type inductor has a composite structure in which parts around the conductive circuits and the conductive vias of the coil part are formed of a ferrite material.

17. The multilayer type inductor of claim 16, wherein the coil part is formed of multiple layers of conductive circuits that are interconnected by the conductive vias, and wherein the core is formed of a metal powder that is free of ferrite and extends through each of the multiple layers of conductive circuits of the coil part.

18. The multilayer type inductor of claim 15, wherein the insulating layer is disposed between the inductor main body and the external electrodes.

19. A multilayer type inductor, comprising:

an inductor main body formed by laminating a plurality of sheets formed of a ferrite material or a non-magnetic material;

a coil part formed of the conductive circuits on the plurality of sheets that are interconnected by the conductive vias; and an insulating layer disposed to cover an outer surface of the inductor main body except for exposed portions of the coil part, wherein the inductor main body has a core formed inside of the coil part, and the core has a through hole therein, and the through hole is filled with a metal powder.

20. The multilayer type inductor of claim 19, wherein the insulating layer is disposed between the inductor main body and external electrodes formed on both ends of the inductor main body.

* * * * *